United States Patent [19]

Gabler et al.

[11] Patent Number: 4,483,096

[45] Date of Patent: Nov. 20, 1984

[54] LAUNCHING PLATFORM FOR INERTIA VEHICLE

[75] Inventors: Otto L. Gabler, Redondo Beach; Wayne R. Halford, Manhattan Beach; Eugene J. Kilroy, Palos Verdes Estate; Michael T. McKittrick, Torrance, all of Calif.

[73] Assignee: Mattel, Inc., Hawthorne, Calif.

[21] Appl. No.: 476,006

[22] Filed: Mar. 17, 1983

[51] Int. Cl.[3] ..... A63H 29/20

[52] U.S. Cl. ..... 446/430

[58] Field of Search ..... 46/1 K, 209, 206, 202

[56] References Cited

U.S. PATENT DOCUMENTS

| | | | |
|---|---|---|---|
| 3,605,328 | 12/1969 | Kilroy, Jr. | 46/83 |
| 3,803,756 | 4/1974 | Strongin | 46/202 |
| 3,886,682 | 6/1975 | Feda et al. | 46/209 X |
| 3,895,458 | 7/1975 | Lemelson | 46/206 X |

FOREIGN PATENT DOCUMENTS

| | | | |
|---|---|---|---|
| 740559 | 11/1955 | United Kingdom | 46/209 |

*Primary Examiner*—F. Barry Shay

*Attorney, Agent, or Firm*—Ronald M. Goldman; James G. O'Neill; Max E. Shirk

[57] ABSTRACT

A toy vehicle energizer and launcher (10) having a draw string energizing mechanism (30) with a drive spool (40) receiving a draw string (38) and a return spring (46). The drive spool (42) is connected to a toothed driving wheel (54) by a one-way clutch (67) which allows a vehicle (34) held in the launcher (10) to be energized by a number of pulls on the draw string (38). A retaining and release means (32) coacts with a drive wheel (56) of the toy vehicle (34) and a toothed driver (54) to allow the vehicle (34) to be held within the launcher (10) during energization, and to be released after energization by manual actuation of the retaining and release means (32).

5 Claims, 8 Drawing Figures

10
12
14
16
18
20
22
24
26
28
30
32
36
38
40
42
44
46
48
50
52
53
54
60
62
64
66
67
68
70
72
76
78
80
82
84
85
86
88
90
92
94
96
98

10
18
44
4
5
86
85
58
40
30
78
72
84
52
3
82
54
80
64
90
67
46
42
32
94
50
53
92
18
14
48

38
34
10
74
30
58
86
20
46
67
56
78
32
12
100
76
54
80
82
90
64
84
52
40
72
14
85
84
72
42
44

32
86
92
12
22
88
90
98
94
14
96

LAUNCHING PLATFORM FOR INERTIA VEHICLE

DESCRIPTION

1. Technical Field

This invention relates to vehicle launchers and more particularly to a pull string actuated energizer and launcher for use with toy vehicles.

2. Background Art

Toy vehicles are a constant source of amusement for children of all ages. Many of the vehicles used by a child include inertia type motors having flywheels, gear trains, and drive wheels forming an energy storing drive train system. These vehicles may be actuated by hand or by energizer and/or launcher means. One such launcher is disclosed in U.S. Pat. No. 3,803,756. The launching device includes a platform on which a toy vehicle is received and an electrical motor within the launcher interconnected to a flywheel of the toy vehicle. The electric motor rotates the flywheel of the toy vehicle when the vehicle is in a stationary position to store inertia energy in the flywheel. When the electric motor is disconnected from the flywheel drive, the vehicle is simultaneously lowered and the flywheel moves into engagement with the platform of the launcher to propel the vehicle forwardly from the platform. Batteries are held within the launcher to operate the electric motor.

Another toy vehicle launcher is shown in U.S. Pat. No. 3,886,682, wherein a two-wheel vehicle, such as a motorcycle, is shown mounted on a platform held in the launcher. A flywheel motor mounted in the body of the motorcycle is rotated by a hand operated rotating drive wheel 63 having a handle 66. The drive wheel is interconnected to the motorcycle to rotate the flywheel therein and store inertial energy in the flywheel, prior to the automatic release of the motorcycle upon stopping of the drive wheel.

In addition, U.S. Pat. No. 3,605,328 discloses means for launching a large rotor from a launching platform wherein the rotor is energized by means of a pull string operator mounted within the frame of the launcher.

However, none of the prior art devices show a simple, inexpensive, easy to use inertia motor toy vehicle energizing and launching means having a pull string actuator and separate releaase means.

DISCLOSURE OF THE INVENTION

In accordance with the present invention, a toy vehicle energizer and launcher means for energizing an inertia motor within a toy vehicle adapted to be connected to the launcher is provided. The launcher includes a housing having two enlarged side portions with a platform therebetween, adapted to hold a vehicle. The launcher also includes a carrying and holding handle between the enlarged sides of the platform. Energizing means is held within one side of the housing and includes a pull string actuator. Manual release means are also provided to operate the vehicle after it has been energized by operation of the pull string.

The energizing means is connected through a one-way clutch to a driving means to allow a vehicle to be energized by a plurality of pulls on the pull string.

Further objects, features and advantages of the invention will become apparent upon the reading of the specification when taken in conjunction with the attached drawings in which like reference numerals refer to like elements in the several views.

BEST MODE FOR CARRYING OUT THE INVENTION

Figures 1, 1A:
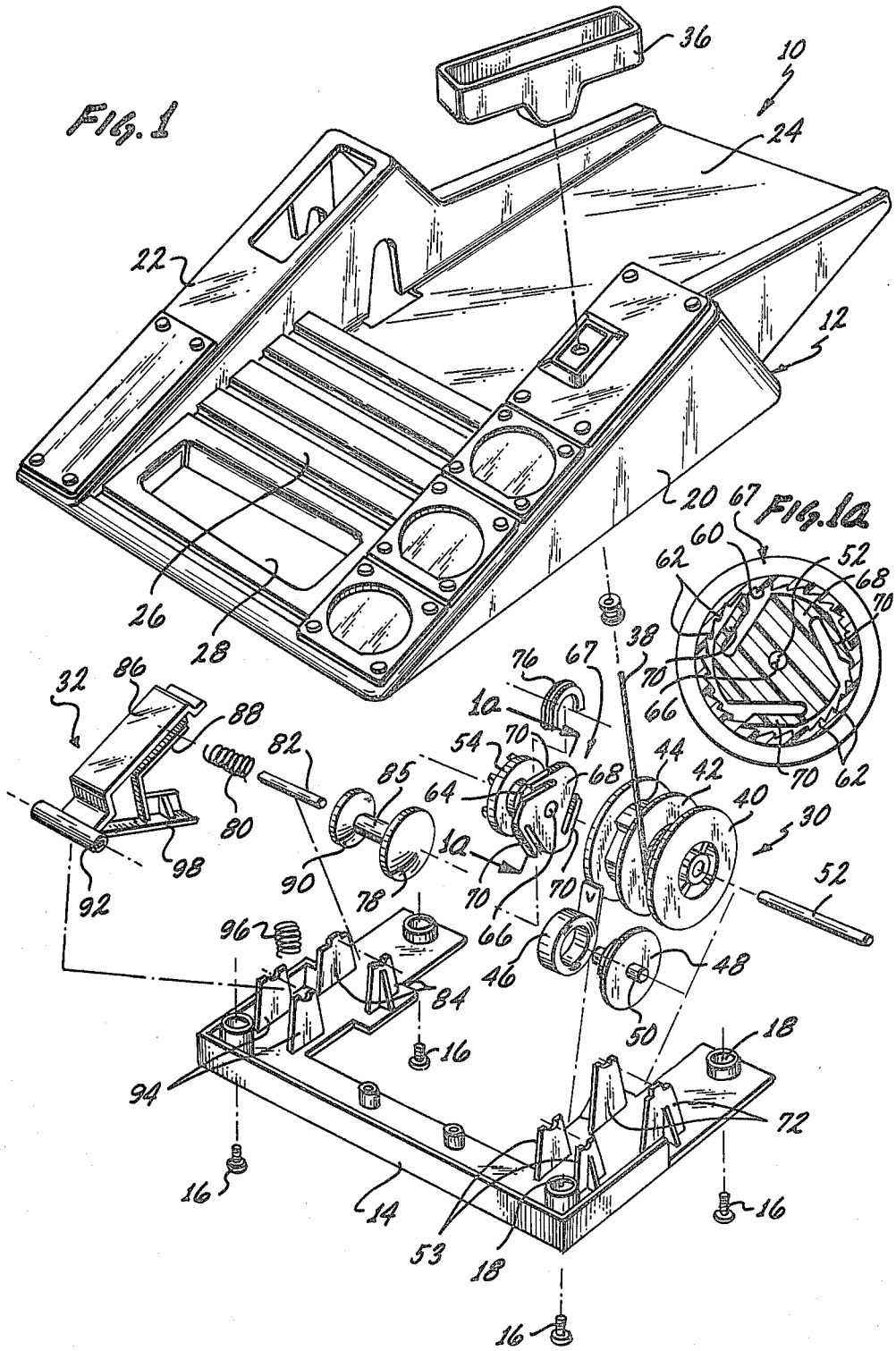
FIG. 1 is an exploded perspective view of the energizer and launching means of the present invention.
FIG. 1*a* is an enlarged sectional view showing the one-way clutch or ratchet.

Referring now to the drawings, and particularly FIGS. 1 through 5, there shown is a launcher 10 comprising a toy vehicle energizing and launching means in accordance with the present invention. The launcher includes a housing 12 connected to a base 14, in any convenient manner, as by the use of screws 16 passing through holes 18 in the base and securely holding the base to the housing 12.

The housing 12 is preferrably formed in one piece, as by injection molding a high-strength plastic material, and includes two hollow, enlarged right and left side portions 20, 22 on either side of a central launching platform 24. Adjacent the launching platform, also between the two sides, is a combination carrying and holding surface 26, including ribs and an opening 28 through which the hand of a user may pass to grasp and carry the launcher.

The housing 12 when fitted over and secured to the base 14, aligns the hollow right and left side portions 20, 22 over energizing and releasing means held on base 14. Driving or energizing means 30, as shown in FIGS. 1–3, 6, and 7, is held on base 14 within one side, that is the right side portion of the housing as shown in FIG. 1. If desired, the energizing means may be held within the left side portion. Combination retaining and release means 32 is held on base 14 within the other, or left side portion of the housing.

Both the energizing means and the retaining and release means are mounted on tabs extending upwardly from and formed integrally with the base 14. A portion of each of these means extends outwardly from its respective hollow housing portion in aligned relationship over the launching platform 24 to capture a vehicle therebetween, as described more clearly hereinafter.

Figure 2:
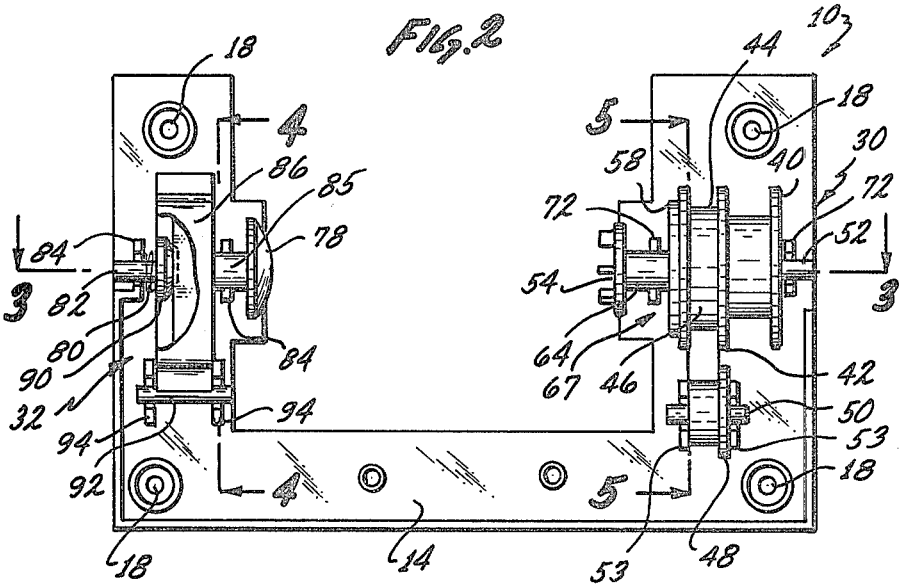
FIG. 2 is a top plan view of the base with the housing removed showing the operating components in position to hold and energize a vehicle.
Figure 3:
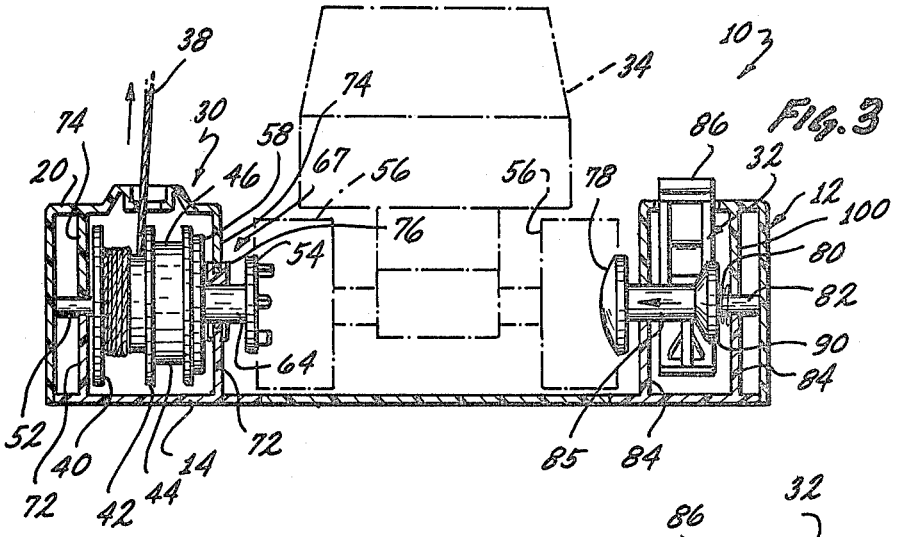
FIG. 3 is a sectional view taken along line 3—3 of FIG. 2, and showing a toy vehicle in broken line held between the vehicle energizer and the retaining means.
Figure 4:
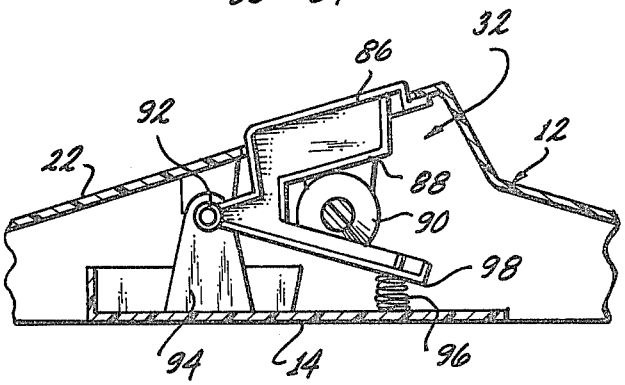
FIG. 4 is a partial sectional view taken along line 4—4 of FIG. 2 showing portions of the retaining and release means for a vehicle.
Figure 5:
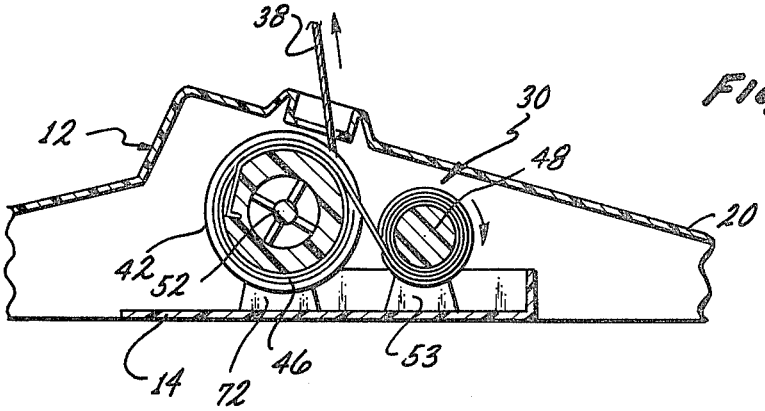
FIG. 5 is a partial sectional view taken along line 5—5 of FIG. 2 showing some of the components of the pull string actuator.
Figure 7:
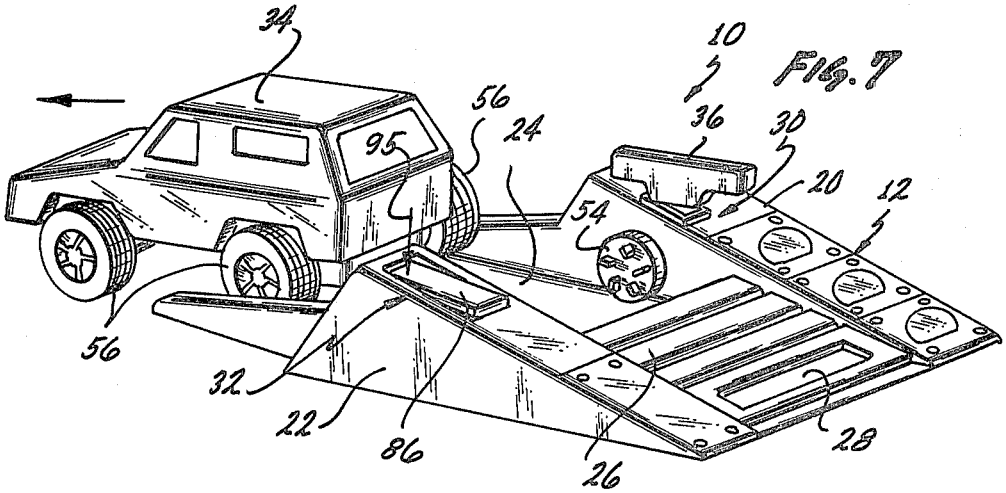
FIG. 7 shows the vehicle launcher of FIG. 6 after release of the pull string actuator and operation of the retaining and release means to launch the vehicle.

Briefly, as shown more clearly in FIGS. 1 through 3, and 5, the driving or energizing means 30 is intended to rotate an inertia motor held within a toy vehicle, such as vehicle 34 shown in broken line in FIG. 3 and in solid line in FIGS. 5 and 7. Any type of two wheel or four wheel vehicle may be energized by the present invention. Examples of four wheel vehicles are shown in U.S. Pat. Nos. 4,141,256 and 4,154,121 assigned to Mattel, Inc., the assignee of the instant invention. The energizing means is operated by pulling on a handle 36 attached to the outer end of a draw or pull string 38. The inner end of the string is secured to a first arbor or drum portion 40 of a drive spool, generally designated 42, having a second drum portion 44 into which one end of a coil or return spring 46 is held. Return spring 46 has its other end held within a spool 48 and is capable of being wrapped around spool 48. Spool 48 and drive spool 42 include shafts 50, 52 extending centrally therethrough, with shaft 50 being supported on recesses formed in tabs 53 formed integrally with the base portion 14.

The inner end of draw string 38 is fixed to and wound around drum portion 40 in a first direction while the return spring 46 is coiled about the second drum portion 44 in the opposite direction. The net effect of the opposite rotation of the elements is that when the draw string 38 is pulled outwardly, it acts against the bias of return spring 46, whereby upon release of the draw string, the draw string will be rewound or recoiled about the drum portion 40. The draw string 38 may be repeatedly pulled against the force of the return spring 46, to rotate, through a clutch or ratchet mechanism 67 (hereinafter described) a toothed driver 54. The toothed driver is engaged with a drive wheel 56 of a vehicle suspended above the platform 24 to energize the inertia motor within the vehicle for ultimately driving the vehicle. Although a single pull on draw string 38 will energize the inertia motor of the vehicle 34, upon repeated pulling of the draw string 38, prior to releasing the vehicle, a larger number of revolution per minutes may be effected to thereby increase the speed and/or the length of time the vehicle operates once it is released from the launcher.

The one-way clutch or ratchet 67, through which the toothed driver 54 is driven by the actuation of the drive spool 42, will now be described. End plate 58 of the second drum 44 includes a circular opening 60 therein having a plurality of ratchet teeth 62, with the shaft 52 extending centrally of the opening. The toothed driver 54 is connected by a hollow shaft 64, having a central opening 66 formed therein, to a clutch disc 68 which slides over shaft 52 via opening 66. Clutch disc 68 includes a plurality of pawl members 70, the ends of which coact with the ratchet teeth 62 to prevent turning of the clutch disc 68 in one direction (during the pull of draw string 38) while allowing the clutch disc 68 and attached toothed driver to be freely rotatable in the other direction (during return of draw string 38).

The energizing means 30 is rotatably mounted on the base 14 between tabs 72 formed integrally with the base 14 and further tabs 74 formed integrally with the housing 12 when base and housing are assembled together, as shown in FIG. 3. A bearing 76 is fitted over the hollow shaft 64 and is held within an opening formed in the right side housing 20 (FIG. 1) to allow free rotation of the toothed driver 54 upon actuation of the energizing means 30.

Mounted within the other or left side portion of the housing 12 (FIG. 1), on the base 14 and diagonally aligned with the toothed driver 54 is the retaining and release means 32. This means is comprised of a follower 78 normally biased inwardly toward the platform 24, in the direction of the toothed driver 54, by means of a coil spring 80. In this manner, the drive or drive wheels 56 of the vehicle 34 are held between the tooth driver 54 and follower 78 a predetermined spaced distance above platform 24. Follower 78 is mounted on a shaft 82 by means of an elongated central cylindrical portion 85. The follower is reciprocably mounted on shaft 82 and rotatably mounted on tabs 84 formed integrally with and extending upwardly from the base 14. The follower 78 is normally biased inwardly by the action of the coil spring 80, and may be forced outwardly by means of a handle 86 having a downwardly extending rib portion 88 which coacts with a button 90 formed integrally with the cylindrical portion 85 of the follower 78, whereby upon downward movement of the handle 86, the button 90 will be moved outwardly away from the platform 24 (to the left, as shown in FIGS. 1 and 2, or to the right as shown in FIG. 3). This outward movement, away from the toothed driver 54, releases the drive wheel or wheels of a vehicle held between the toothed driver and follower 78, whereby the drive wheel of the energized vehicle will be dropped to the platform 24 for forward movement of the vehicle away from the platform (see FIG. 7).

The handle 86 includes a circular shaft-type portion 92 formed integrally therewith. Shaft 92 seats in openings formed in a pair of tabs 94 formed integrally on and extending upwardly from the base 14. In this manner, when the handle 86 is pushed downwardly, as shown by arrow 95 in FIG. 7, the handle will move into the housing against the biasing action of a coil spring 96 acting against the integral lower portion 98 of the handle.

As shown in FIG. 3, when the housing 12 is fixed in position over the base 14, the follower 78 of the retaining and release means 32 is reciprocably and roatably held in position by the action of the tabs 84 formed within the base, and further tabs 100 formed within housing 12.

Figure 6:
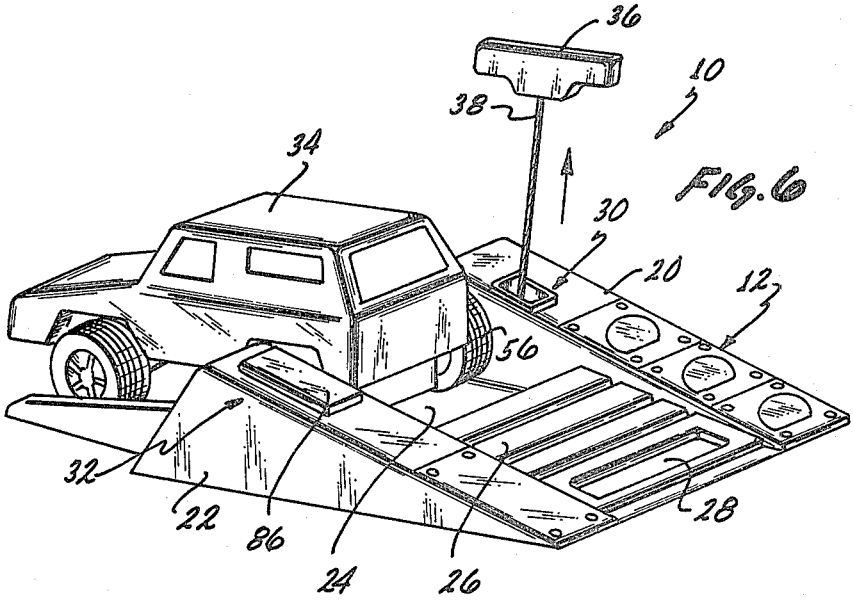
FIG. 6 is a perspective view of the launcher of the present invention showing a toy vehicle contained therein, with the pull string actuator in the operated position after having energized the motor of the toy vehicle.

In summary, the invention comprises a unique energizer and launching system for operation of inertia motor driven toy vehicles in which a toy vehicle is mounted within the launcher with its drive wheel or wheels raised above the platform 24. The opposite sides of a single drive wheel or the opposite sides of two drive wheels are held between a toothed driver 54 and follower 78. An inertia type motor within the vehicle is energized by operation of the draw string handle through the energizing system 30. The draw string may be actuated as many times as desired by the user of the launcher. This is accomplished by pulling on the handle 36, letting the handle return to its rest or stop position (FIG. 7) by action of the return spring 46 held between the drum 44 and spool 48. The one-way clutch 67 allows free return of the draw string from the actuated position (FIGS. 3, 5 and 6). Pulling on the handle 36, from the rest or stop position (FIG. 7) actuates the toothed driver 54 through the coaction of pawls 70 with ratchet teeth 62. When the desired energization has been supplied to the drive wheel of the toy vehicle, the push button 86 is pressed downwardly (FIG. 7), thereby moving the follower 78, against the bias of spring 80, away from the drive wheel. This outward movement of follower 78 releases the drive wheel of the vehicle from between the follower and toothed driver and allows the drive wheel to drop to the platform 24 for launching of the vehicle. When operating the draw string actuator, a child may place his hand, foot or knee on the holding portion 26 to thereby prevent the launcher from being moved or lifted.

While there has been shown and described a preferred embodiment of the invention, it is to be understood that various other adaptations and modifications may be made within the spirit and scope of the invention, as set forth in the attached claims.

We claim:

1. An inertia motor toy vehicle energizer and launching means comprising:

a housing having a platform adapted to hold said vehicle, two opposed hollow sides upstanding from said platform and a holding area adjacent said platform formed in said housing between said sides;

means for energizing an inertia vehicle held within said housing in one of said hollow sides including a draw string and adapted to be connected to a drive wheel of said toy vehicle held over said platform between said sides for energization thereof; and retaining and release means held within said housing in the other of said hollow sides to retain said toy vehicle in a position to be energized and to release said vehicle after energization.

2. The toy vehicle energizer and launching means of claim 1 wherein said retaining and release means includes a handle which is manually actuated to release said toy vehicle after energization.

3. The toy vehicle energizer and launching means of claim 1 wherein said draw string has two ends with a handle attached at one end and the other end attached to a drive drum; said drive drum having a spring return connected therewith, and being further connected to a toothed wheel driver through a one-way clutch to allow a toy vehicle held in said launcher between said toothed wheel driver and said retaining and release means to be energized, by actuating said energizing means.

4. The toy vehicle energizer and launching means of claim 3 wherein said retaining and release means comprises a follower fixedly connected to a rounded button, and a handle mounted within said housing whereby upon manual actuation of said handle, said handle will contact said rounded button to move said follower away from a vehicle held therein, to thereby release said vehicle.

5. An inertia motor toy vehicle energizer and launching means comprising:

a platform having an upper surface and opposed sides projecting upwardly therefrom;

energizing means held within said launching means at one of said sides and means adapted to releasably hold and support a vehicle having an inertia motor and at least one two-sided drive wheel in a forwardly aligned position with its drive wheel out of engagement with said platform so that said drive wheel may rotate freely; said energizing means including a draw string connected through a clutch means to a toothed driver adapted to be connected to one side of said drive wheel;

and a follower on the other side of said platform, biasing means holding said follower against the other side of said drive wheel; said follower including manually actuable means to move said follower, against the force of said biasing means, away from said other side of said drive wheel, after said draw string has been pulled a sufficient number of times to impart the desired energization to said drive wheel, whereby said drive wheel will be released and drop to said platform to thereby apply forward motion to said vehicle.

* * * * *